US005669505A

United States Patent [19]

Mayer

[11] Patent Number: 5,669,505

[45] Date of Patent: Sep. 23, 1997

[54] DISPOSABLE SERVING TRAY

[76] Inventor: Calvin M. Mayer, P.O. Box 456, Casselton, N. Dak. 58012

[21] Appl. No.: 629,411

[22] Filed: Apr. 8, 1996

[51] Int. Cl.[6] ..... B05B 5/20

[52] U.S. Cl. ..... 206/565; 229/902; 495/906

[58] Field of Search ..... 206/557, 565, 206/784; 229/902, 904, 904.1; 493/906, 912, 136, 137, 138, 140, 151

[56] References Cited

U.S. PATENT DOCUMENTS

| | | | |
|---|---|---|---|
| D. 306,114 | 2/1990 | Moll . | |
| 889,434 | 6/1908 | Bustanoby . | |
| 2,391,285 | 12/1945 | Williamson et al. | 206/565 |
| 2,503,801 | 4/1950 | Clarke . | |
| 3,805,384 | 4/1974 | Falcone . | |
| 3,995,902 | 12/1976 | Sciaino . | |
| 4,979,657 | 12/1990 | Espiritu | 229/904 X |

*Primary Examiner*—Jacob K. Ackun
*Attorney, Agent, or Firm*—Richard C. Litman

[57] ABSTRACT

A disposable food serving tray is formed of a single sheet of flat stock material, cut and folded to provide a tray with four upstanding walls for the containment of an article of food therein. The folding pattern provides leakproof corners, precluding leakage or spillage of liquids (melted butter, water, etc.) from the tray. One end of the tray includes a raised support, or alternatively a retaining passage, therein, providing for the support or retention of any handle means (skewer or husk extending from an ear of corn, etc.). The present tray is preferably formed of coated paper stock to provide economy and to preclude soaking through of the material, but alternatively other materials (plastic sheet, etc.) may be used. The present tray is particularly adapted to dispensing with foods typically provided at carnivals, fairs, and other outdoor gatherings and exhibitions, and the inexpensive nature of the tray provides for the economical disposal of the tray after a single use, along with any inedible portions of the food product contained therein (skewer, corn cob and husk, etc.). While the present tray is particularly adapted to use with roasted or boiled corn on the cob, it is also quite useful with other elongate articles of food (corn dogs with skewers, etc.).

20 Claims, 5 Drawing Sheets

DISPOSABLE SERVING TRAY

FIELD OF THE INVENTION

The present invention relates generally to articles used for the individual serving and consuming of food, and more specifically to a disposable serving tray particularly adapted to hold an ear of corn or other similarly shaped comestible therein. The tray is cut from coated flat paper stock of other suitable sheet material, and is folded in a configuration precluding leakage of liquids (butter, etc.) from the lower corners thereof.

BACKGROUND OF THE INVENTION

Fairs, carnivals, outdoor shows, and other gatherings typically include vendors providing various types of food and drink for attendees. At most such events, little if any thought is given to utensils for serving such comestibles, other than a paper cup for drinks and a few napkins for solid foods. While this does provide further economy in such food service, the lack of a tray, dish, or other container for food often results in spillage by the consumer, even when using great caution while eating the food.

In fact, some attendees at such gatherings will avoid certain foods (e. g., fresh corn on the cob), even though they may enjoy the food and its flavor at other times, due to the relative trouble and mess often accompanying such foods. Typically, ear corn at such events is prepared by stripping back the husk after cooking (or removing the husk and impaling the ear on a skewer), and dipping the exposed ear into a container at least partially filled with melted butter (generally comprising a liquid layer floating atop a volume of water).

While the result may be considered delicious, the liquid butter (along with any water picked up with the butter) is difficult to control. If one tilts the husk or skewer end of the ear downward, the liquid tends to run down the husk or skewer and onto the consumer's hand. Other orientations often result in butter and water dripping from the ear itself, and perhaps onto the clothing of the individual attempting to eat the corn. While whole ear corn may be one of the messier types of food available at such gatherings, other foods, and particularly condiments applied to the outer surface thereof, can also result in a mess unless the consumer is particularly cautious; corn dogs, with mustard or ketchup, are a further example of this type of food.

Accordingly, a need will be seen for a relatively small, disposable, single serving size open tray or container which may used to capture any drips or spills which may emanate front such food products. The container must be extremely easy and economical to manufacture, in order to keep the distribution costs down in view of its disposability after a single use. The tray must provide for the secure holding of "finger food" type comestibles, particularly in elongate form and having a "handle" (e. g., corn husk, skewer, etc.) extending therefrom. Preferably, the tray should be formable from a single sheet of material, with corner folds providing for the secure containment of any liquids which may run from the food article contained therein. Different embodiments may provide for the positive capture of a "handle" portion extending from the food article, or alternatively may provide a rest for the "handle" portion. In either case, the present tray must be economical, easily assembled, and provide for the positive capture of any liquids spilling from foods contained therein.

DESCRIPTION OF THE PRIOR ART

U.S. Pat. No. 889,434 issued to Jacques Bustanoby on Jun. 2, 1908 describes a Corn Holder in the form of a concave trough of unitary construction, with a stand having plural legs extending therefrom. While no particular material is described, the Bustanoby device does not lend itself to construction from flat stock, as provided by the present invention. The legs and stand, scraper portion, and other features in combination with the cob forks included, result in a device which is neither constructed in the manner of the present invention, nor economically disposable after a single use.

U.S. Pat. No. 2,503,801 issued to Charles J. Clarke on Apr. 11, 1950 describes a Corn Holder having an upstanding base with adjustable opposite supports adapted for the support of cob skewers thereon. The base is formed of plastic, porcelain, glass, or other material capable of having an ornate design formed therein, and thus is obviously not economically disposable after a single use. While the Clarke device has a slight depression for the capture of liquid which may drip from the ear, no upstanding walls are provided, as in the present invention.

U.S. Pat. No. 3,805,384 issued to Anthony J. Falcone on Apr. 23, 1974 describes a Corn Kernel Removing Tool comprising a fork with sharpened edges between the tines. An elongated bowl is also provided to support an ear of corn on oppositely disposed skewers. The bowl is unitarily formed of a sheet of material having compound curvature at least at each end, and is also adapted to be sufficiently sturdy as to provide a brace for the corn ear while removing the kernels with the tool. The result is structurally and functionally distinct from the present invention.

U.S. Pat. No. 3,995,902 issued to Bartolo Sciaino, Jr. on Dec. 7, 1976 describes a Corn Holder Construction primarily directed to skewers adapted to be inserted in opposite ends of the cob. However, a dish or tray is also disclosed, with the primary emphasis being placed upon a peripheral storage means for the skewers. Otherwise, the dish is more closely related to the Falcone device discussed immediately above, than to the present disposable food tray.

Finally, U.S. Pat. No. D-306,114 issued to Stanley Moll on Feb. 20, 1990 describes a design for a Corn Cob Holder, comprising a skewer having four barbed tines extending therefrom. The opposite handle portion includes an opposed spiral groove pattern and a knob, with the grooves and knob apparently providing gripping means for the handle. No tray of any form is disclosed in the Moll design disclosure.

None of the above noted patents, taken either singly or in combination, are seen to disclose the specific arrangement of concepts disclosed by the present invention.

SUMMARY OF THE INVENTION

By the present invention, an improved disposable serving tray is disclosed.

Accordingly, one of the objects of the present invention is to provide an improved disposable serving tray which may be constructed from a single planar sheet of material which is cut or otherwise formed in an appropriate pattern, and folded to provide the present tray.

Another of the objects of the present invention is to provide an improved disposable serving tray which is preferably constructed of a liquid proof sheet material, such as coated paper or other economical substantially leak proof material, but which may also be formed of relatively thin plastic sheet or other suitable material.

Yet another of the objects of the present invention is to provide an improved disposable serving tray which corners are folded to provide a leak proof seal at the lower corners and edges thereof.

Still another of the objects of the present invention is to provide an improved disposable serving tray which includes a rest at one end for a handle or other extended portion of the food product therein, which rest may comprise an open semicircular configuration or a completely closed configuration as desired.

A further object of the present invention is to provide an improved disposable serving tray which is particularly adaptable to the carriage of ear corn, corn dogs, or other similarly configured, elongate comestibles having a handle or extension means thereon, but which may further be used for the holding of other food articles therein.

A final object of the present invention is to provide an improved disposable serving tray for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Referring now particularly to the drawings, the present invention will be seen to relate to a disposable serving tray 10, providing for the holding of corn on the cob or other portions of "finger food" (corn dogs, etc.) having an elongate configuration and perhaps some handle extension (husk, skewer, etc.) therefrom.

Figure 1:
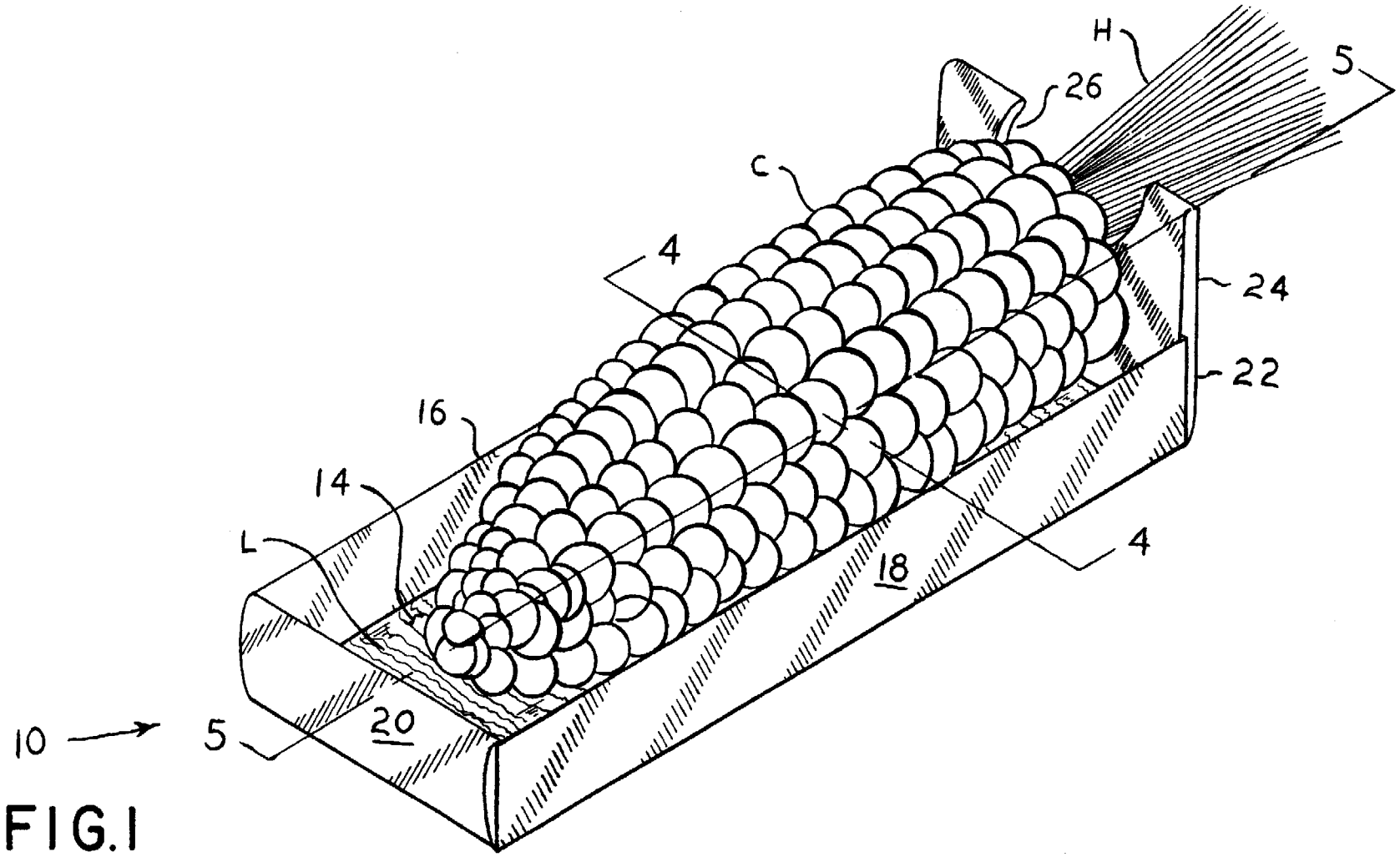
FIG. 1 is a perspective view of a first embodiment of the present serving tray in use, shown holding an ear of corn therein with a husk extending therefrom.
Figure 2A:
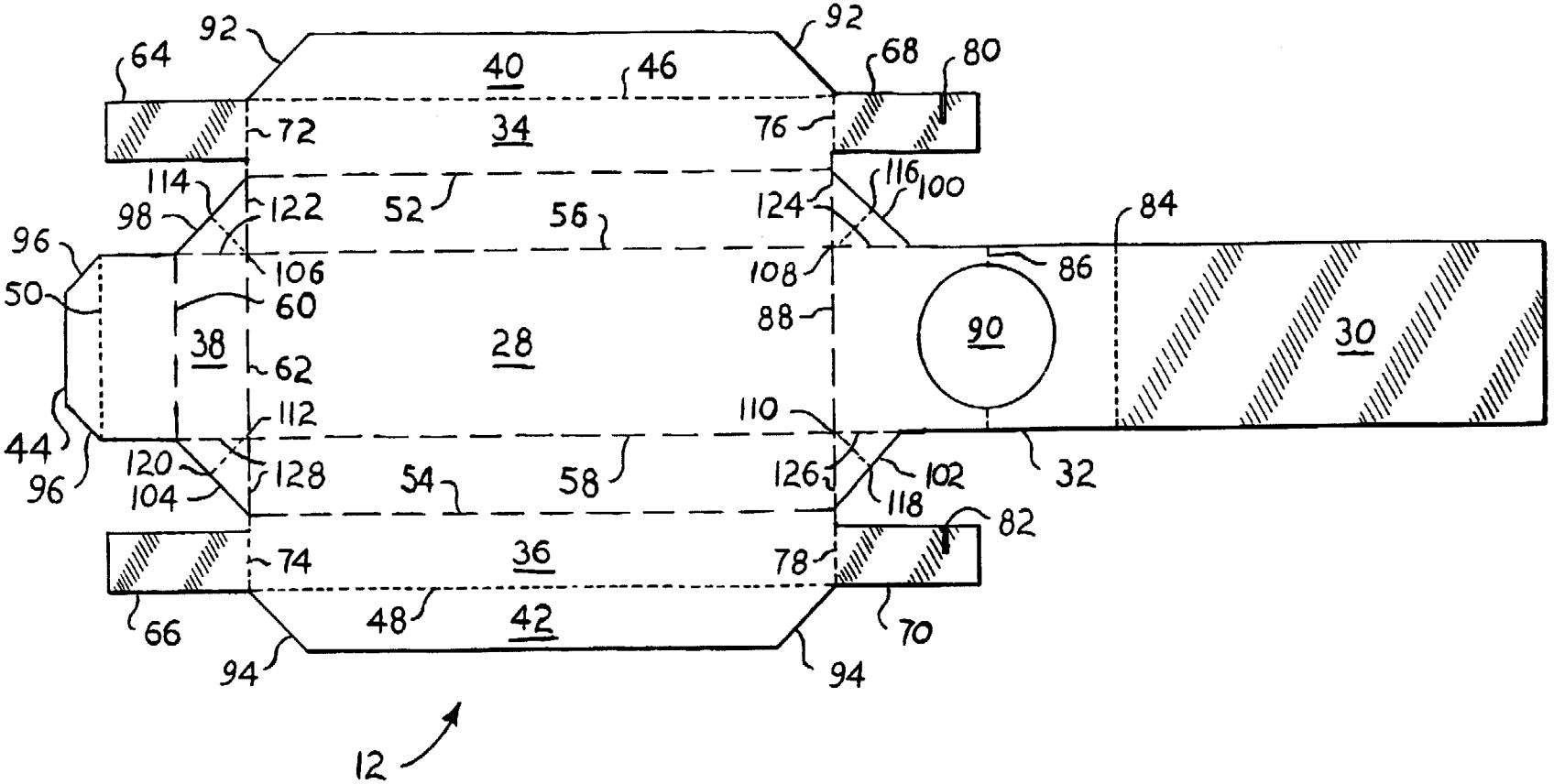
FIG. 2A is a flat pattern used to form the tray of FIG. 1, showing its cut periphery and upward and downward folding patterns.

The present tray 10 is formed from a single sheet of flat, planar stock which is cut or otherwise formed to a pattern 12 as shown in FIG. 2A, and is folded to have the completed configuration shown in the environmental perspective view of FIG. 1. Tray 10 includes a generally rectangular flat bottom portion 14, opposite first and second side walls 16 and 18, and opposite first and second end walls 20 and 22. The specific folding configuration of the pattern blank 12 provides double thicknesses for the bottom portion 14 and all of the side and end walls 16 through 22, for greater strength and protection from leak through of any liquids L which may be contained within the tray 10.

The two side walls 16 and 18, and the first end wall 20, are each of equal height above the bottom portion 14. The second end wall 22, however, includes a portion 24 which extends above the other three walls, and which may be used to support the handle (corn husk H, skewer, etc.) of any food (e. g., ear of corn C) which may be contained within the present tray 10. A concave depression 26 is provided in the upper edge of the handle support portion 24 of the second end wall 22, which is adapted to support a skewer, husk or the like generally referred to as a "handle" H) which may extend from the comestible contained within the tray 10, and to preclude its slippage to one side or the other of the second end 22 of the tray 10.

Figure 3:
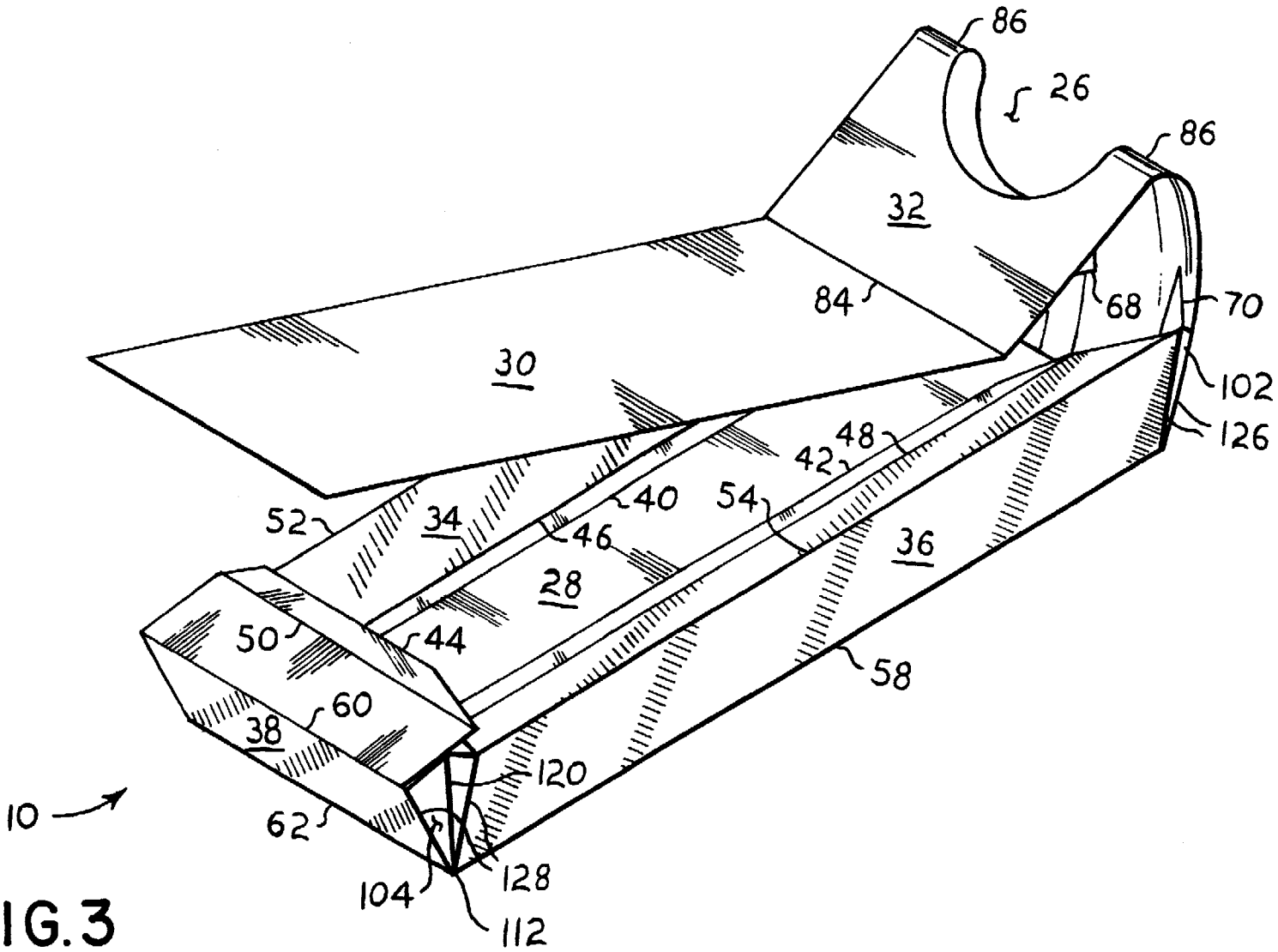
FIG. 3 is a perspective view of the serving tray embodiment of FIGS. 1 and 2A in a partially completed state, showing the direction and order of the various folds involved in the construction thereof.
Figure 4:
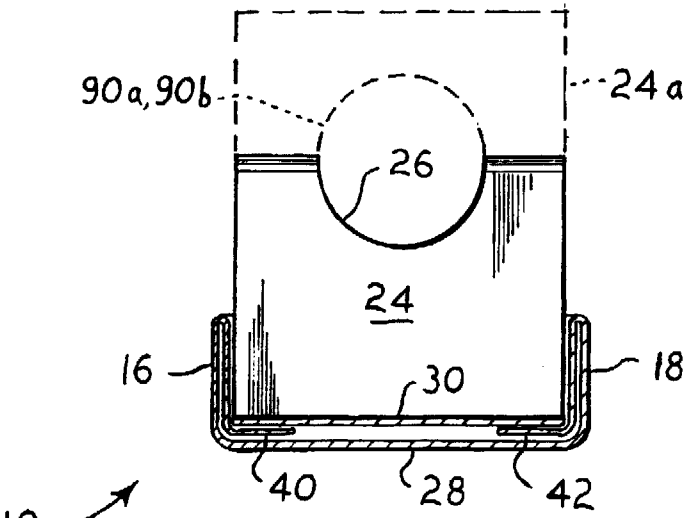
FIG. 4 is a cross sectional view along the transverse line 4—4 of FIG. 1, showing the arrangement of the folded panels thereacross.
Figure 5:
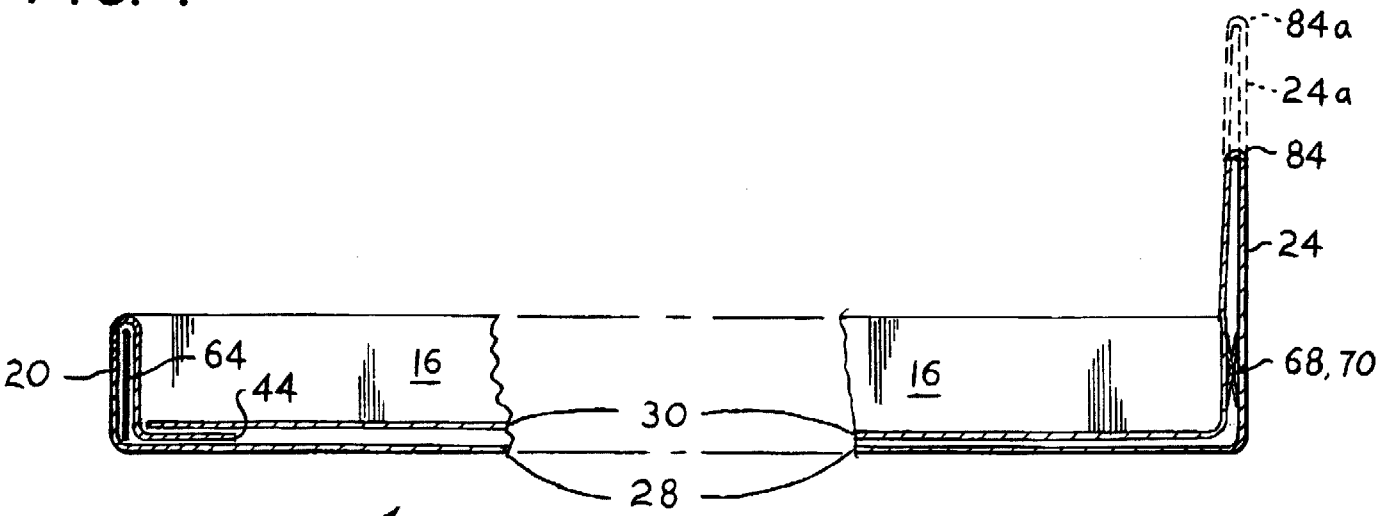
FIG. 5 is a broken cross sectional view along the longitudinal line 5—5 of FIG. 1, showing the arrangement of the folded panels therealong.

The specific folding configuration of the pattern 12 of FIG. 2A is shown in that drawing figure, and also in an intermediate partially folded state in FIG. 3. FIGS. 4 and 5 disclose cross sectional views respectively along lines 4—4 and 5—5 of FIG. 1, to clarify the construction, folding arrangement, and folding order of the present tray 10, further.

Figure 2B:
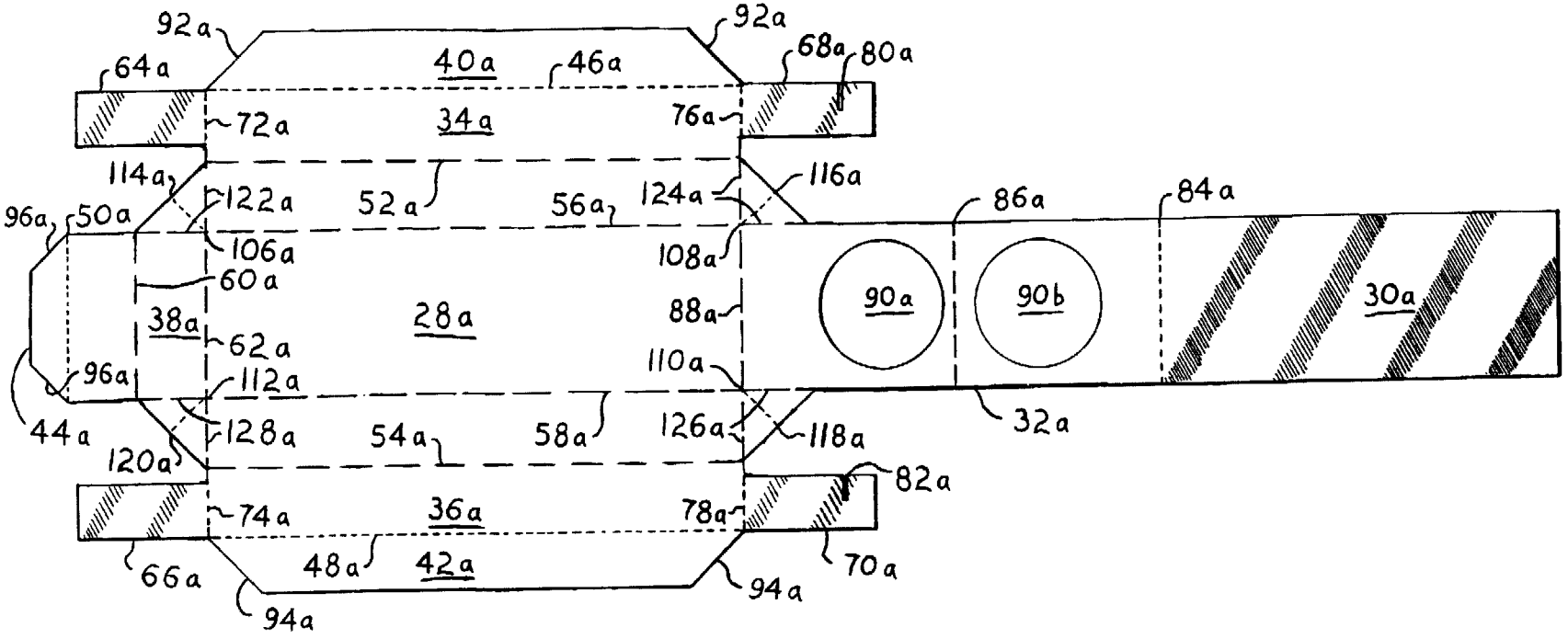
FIG. 2B is a flat pattern used to form a second embodiment of the present tray, showing the cut periphery and folding patterns thereof.

As noted above, the bottom portion 14 and each of the side and end walls 16 through 22 of the present tray 10 comprises a double thickness of material. The lowermost layer or thickness comprises a generally rectangular central portion 28 of the pattern 12, with the second, upper layer comprising an elongate extension 30 of the second end panel 32, which panel 32 is used to form the second end wall 22 of the completed tray 10; this construction is described further below. The folding patterns of FIGS. 2A and 2B are indicated by either longer or shorter dashed lines, with the longer dashes indicating a fold upward from the sheet (which would thus form a concave crease, viewing the pattern 12 from above), and the shorter dashes indicating a downward fold (to form a convex crease in the pattern 12).

Opposite first and second side panels 34 and 36 extend to the sides of the central portion 28, with a first end panel 38 and opposite second end panel 32 with its elongate extension 30 (described above) also extending from the two ends of the central portion 28. The two side panels 34/36 and the first end panel 38 preferably each respectively have first and second side panel extended edges 40 and 42, and a first end panel extended edge 44 extending outwardly from the main portions of the panels 34/36/38, which extended edges 40/42/44 provide additional strength and security for the side walls 16 and 16 and the first end wall 20 of the completed tray 10 structure, as described further below.

The folding of the tray pattern 12 is initiated by first folding the first and second side wall extended edges 40 and 42, and the first end panel extended edge 44, downward (as indicated by the shorter dashed fold lines) respectively along fold lines 46, 48, and 50 so the edges 40/42/44 are perpendicular to the remainder of the pattern 12. The side panels 34 and 36 are folded to form the respective first and second side walls 16 and 18 of the completed tray 10, by forming a first fold (respectively 52 and 54) upwardly and generally medially along each side panel 34/36 to double each panel 34/36 over upon itself, and then forming a second fold (respectively 56 and 58) upward so that the doubled thickness of the two side panels 34/36 form upstanding first and second side walls 16 and 18, generally perpendicular to the bottom portion 14 of the tray 10. The first end panel 38 is folded similarly, with an upward first fold 60 doubling the panel 38, and a second fold 62 to form a double thickness first end wall 20.

The first and second side panels 34/36 also each have a first end tab (respectively 64 and 66) and an opposite second end tab (respectively 68 and 70). These tabs 64/66 are essentially one half the width of the respective side panels 34 and 36, and thus are essentially equal to the height of the completed side walls 16/18 and end wall 20 after folding. Prior to forming the first and second folds 60/62 in the first end panel, the two first end tabs 64 and 66 are folded upwardly and perpendicular to the remainder of the pattern 12 along fold lines 72 and 74, and are tucked between the two thicknesses of the completed first end wall 20 after folds 60 and 62 are completed. Thus, the two side wall 16/18 adjacent the first end wall 20, cannot spread apart from the end wall 20, due to the captured tabs 64/66 between the folded thicknesses of the end wall 20, thereby providing additional structural strength and security for the folded tray 10.

Similarly, the two opposite tabs 68 and 70 are folded upwardly and perpendicular to the remainder of the pattern 12 along fold lines 76 and 78, and are captured within the folded thicknesses of the second end 20 when it is completed. It will be seen that, due to the additional height of the second end wall 22, that the tabs 68/70 are not closely captured therein as the first end tabs 64/66 are within the first end 20 folded structure. Accordingly, a slot (respectively 80 and 82) is formed in each of the second end tabs 68 and 70, to provide for their mutual interconnection. These slots 80/82 will be seen to be disposed respectively in the lower and upper sides of the two tabs 68 and 70, once the side panels 34/36 have been doubled over and folded upwardly to form the two side walls 16 and 18, thus allowing the two slots 80/82 to engage to lock the two tabs 68 and 70 together. A similar arrangement could be provided with the first end tabs 64/66, but it will be seen that such slots are not especially needed here, as the two tabs 64/66 fit closely within the folded structure of the first end wall 20 due to its similar height to the tabs 64/66.

At this point, the second end wall 22 is formed, by forming a first fold 84 downward between the second end panel extension 30 and the second end panel 32, and perpendicular to the remainder of the pattern 12. A second fold 86 is made upwardly to double the second end panel 32 over upon itself, and a third fold 88 is made upwardly and perpendicular to the center portion 28 to complete the second end wall 22. It will be seen that the above described folding pattern, results in the second end panel extension 30 overlying the center bottom portion 28, thereby providing a double bottom layer.

In order to provide greater security for the handle means H or other extension of a food product carried within the present container 10, a recess or depression 26 is formed within the upper extension 24 of the second end wall 22, as noted above. This recess 26 may be conveniently formed by placing a hole or passage 90 through the center of the second end panel 32, with the second fold 86 of the second end panel 32 extending diametrically across this passage 90. Thus, when the second end panel 32 is doubled over along the second fold 86, a recess is folded in the upper edge defined by the fold 86.

In some cases, it may be desired to provide a complete closure of the second end panel about the handle or other extension of the food product within the present tray. Accordingly, a second embodiment may be constructed, for which a pattern **12*a* is shown in FIG. 2B. The various panels and surfaces are identical to those of the first embodiment pattern 12, and are designated accordingly with the lower case letter "a" following each reference numeral in order to indicate a second embodiment. However, it will be noted that two holes or passages (designated 90*a* and 90*b*) are formed in the second end panel 32*a*, and positioned equidistantly from the second fold line 86*a* of the second end panel 32*a*. Thus, when the second end panel 32*a* is doubled over by folding upwardly along the second fold line 86*a*, the two passages 90*a* and 90*b* will overlie one another in a congruent arrangement, and the upper edge of the second end panel 32*a* defined by the second fold 86*a*, will extend completely across the second end wall 22*a* thus formed. Any handle means passing through the passages 90*a*/90*b* will thus be completely enclosed by the surrounding material of the end wall 22*a*. The end result of this construction is shown in the alternative end wall 22*a* constructions shown in broken lines in FIGS. 4 and 5**.

It will also be noted in FIGS. 4 and 5, that the two bottom layers 28 and 30 of the assembled structure also capture a third thickness therebetween, that of the side and end panel extensions 40 through 44. If these extensions were to overlap at their corners, even more additional thickness would be the case. Accordingly, each of the extensions 40 through 44 is provided with bevels, respectively 92 through 96, (or **92*a* through 96*a*, for a tray formed from the pattern 12*a* of FIG. 2B) in order to preclude their overlapping and to allow all of the extensions 40 through 44 to lie coplanar with one another when the present tray is folded. This is indicated generally by the single thickness of the opposite side extensions 40 and 42 in FIG. 4, and the end extension 44 shown in FIG. 5. The first side extension 40 is not shown in FIG. 5**, for clarity in the view.

One of the key provisions of the present tray 10, is that of completely containing any reasonable amount of liquid (e. g., melted butter, water, condiments such as mustard and ketchup, etc.) within the tray 10 to preclude spillage upon the consumer. Accordingly, the present tray 10 is preferably formed of a leak proof material, such as plastic or wax coated paper or the like. Other materials, such as aluminized paper or even plastic sheet, may be used, as desired. Whatever the material chosen, it is important that it preclude the soaking through of any liquids which may be contained within the tray 10.

Be that as it may, it will be seen that some provision to preclude leakage or spillage of liquid from the corner junctions of the present tray is also required, for optimum suitability. The present tray 10 provides for such by means of a web of material, respectively 98 through 104, at each of the four corners, respectively 106 through 112, of the tray 10. Each of the webs 98 through 104 forms a 45 degree angle across the respective corner 106 through 112 in the flat pattern 12. (Like webs **98*a* through 104*a* are provided at the corners 106*a* through 112*a* of the pattern 12*a*.) These webs 98 through 104 are "pinched" upward along medial diagonal folds 114 through 120 (114*a* through 120*a* in the pattern 12*a*), and web periphery folds 122 through 128 (122*a* through 128*a* in pattern 12*a*). As the side walls 16/18 and end wall 20 are folded upwardly, the folded webs 98 and 104 are tucked between the folded first end wall 20 structure, while the folded webs 100 and 102 are similarly tucked into the folded second end wall 22 structure. The partially folded structure may be seen in the fourth corner 112 of the tray 10 of FIG. 3. The vertically upstanding webs captured in the end walls of the tray 10, serve as barriers to any liquids L which may be contained within the tray 10**.

In summary, the above described disposable serving trays **10/10*a*** will be seen to provide a convenient means of precluding spillage and mess which often accompanies the consuming of various types of "finger foods" often enjoyed at fairs, carnivals, picnics, and other outdoor gatherings. The construction of the present trays using liquid proof sheet materials, and the specific corner construction, preclude spillage or leakage of liquids therefrom. The present tray will be seen to be particularly adapted to use with roasted or boiled corn on the cob, but will be seen to well suited for many other foods as well, such as corn dogs or even hot dogs or similarly shaped foods. In the event the retaining means for any "handle" normally associated with the food is not required (as with a hot dog), the passage or depression in the second end wall will be seen to provide an extremely convenient thumb hold or rest to provide the user with a more secure grip of the tray. When the consumer has finished the meal, the entire tray, along with any inedible or unfinished portion of the food therein, may be economically disposed with, due to the extremely economical construction of the present tray from a single inexpensive sheet of material, in its various embodiments.

It is to be understood that the present invention is not limited to the sole embodiments described above, but encompasses any and all embodiments within the scope of the following claims.

I claim:

1. A disposable, single service food serving tray, comprising:

a single thin, planar sheet of material folded to form a rectangular bottom portion with a first and an opposite second side wall and a first and an opposite second end wall extending upwardly therefrom;

said bottom portion and each said end wall being formed of at least two thicknesses of said sheet of material, and;

said second end wall including a folded handle support portion extending upwardly above said side walls and said first end wall, whereby;

said tray serves to hold and retain an article of food placed therein to preclude spillage therefrom, and is further adapted to provide for the economical disposal of said tray after a single use.

2. The serving tray of claim 1, including:

a first, second, third, and fourth corner, with each said corner including means precluding the leakage of liquids therefrom.

3. The serving tray of claim 2, wherein:

said sheet of material includes a web of material extending between each adjacent said wall, with each said web being folded upwardly into one said end wall to preclude leakage of liquids from said tray.

4. The serving tray of claim 1, wherein:

said handle support portion comprises two thicknesses of material formed of a folded portion of said sheet of material, with said folded portion having a fold line defining an upper edge of said handle support portion, and;

said upper edge of said handle support portion includes a concave open depression therein, formed by means of said fold line extending across a single passage formed through said handle support portion.

5. The serving tray of claim 1, wherein:

said handle support portion comprises two thicknesses of material formed of a folded portion of said sheet of material, with said folded portion having a fold line defining an upper edge of said handle support portion, and;

said two thicknesses of said handle support portion include congruent passages therethrough, formed by means of two said passages formed through said handle support portion.

6. The serving tray of claim 1, including:

interlocking tabs extending across at least one said end wall and captured between said two thicknesses of material thereof.

7. The serving tray of claim 1, wherein:

said bottom portion of said tray includes a periphery, and;

each said side wall and said first end wall include an extended edge folded to overlap at least said periphery of said bottom portion of said tray, with each said extended edge being captured between said two thicknesses of said bottom portion.

8. The serving tray of claim 7, wherein:

each said extended edge includes opposite beveled corners adapted to abut one another so that each said extended edge is coplanar to one another when said tray is assembled.

9. The serving tray of claim 1, wherein:

said thin, planar sheet of material is liquid impervious and comprises coated paper.

10. The serving tray of claim 9, wherein:

said coated paper is aluminized.

11. The serving tray of claim 1, wherein:

said thin, planar sheet of material is plastic.

12. A method of constructing a disposable, single service food serving tray, comprising the following steps:

(a) providing a thin, planar, foldable sheet of material having a rectangular central portion, a first and an opposite second side panel extending therefrom, and a first and an opposite second end panel extending therefrom, with the second end panel being longer than the first and second side panel and first end panel and further having an extension therefrom;

(b) forming a first fold along each side panel and first end panel upwardly and medially therealong and over upon itself to provide two thicknesses of material for each side panel and first end panel, and further forming a second fold along each side panel and first end panel upwardly parallel to each respective first fold and along a line respectively between each side panel and first end panel and the central portion, thereby forming a completed vertically upstanding first and second side wall and a first end wall each having two thicknesses of material thereto, and;

(c) forming a first fold of the second end panel extension downward from the second end panel and perpendicular thereto, forming a second fold of the second end panel upward and over upon itself to provide two thicknesses of material for the second end panel, and further forming a third fold upward along a line between the second end panel and the rectangular central portion and perpendicular thereto, thereby forming a completed vertically upstanding second end wall having two thicknesses thereto and higher than the first and second side panel and the first end panel, and thereby also forming a bottom portion comprising the rectangular central portion and the resulting overlying extension of the second end panel.

13. The method of constructing a serving tray according to claim 12, further comprising the steps of:

(a) providing leakproof corners for the tray by forming a web of material extending between each adjacent wall, and;

(b) folding each web upwardly into one end wall to preclude leakage of liquids from the tray.

14. The method of constructing a serving tray according to claim 12, further comprising the steps of:

(a) forming a single passage through the second end panel and second end panel extension along a line defined by the second fold of the second end panel, and;

(b) forming a handle support along the upper edge of the second end panel, comprising a concave open depression therein formed by the second fold of the second end panel passing across the single passage of the second end panel and second end panel extension.

15. The method of constructing a serving tray according to claim 12, further comprising the steps of:

(a) forming two passages respectively through the second end panel and second end panel extension and equidistant from a line defined by the second fold of the second end panel, and;

(b) forming a handle support within the second end wall, comprising a single passage therethrough formed by the congruent overlying of the two passages of the second end panel and second end panel extension by means of the second fold of the second end panel.

16. The method of constructing a serving tray according to claim 12, further comprising the steps of:

(a) providing opposite first and second slotted tabs extending at least from the first side panel and the second side panel and adjacent the second end panel;

(b) interlocking the slots of the tabs to provide positive linking of the first side panel and the second side panel adjacent the second end of the tray, and;

(c) capturing the tabs between the two thicknesses of the second end panel.

17. The method of constructing a serving tray according to claim 12, further comprising the steps of:

(a) providing a first and a second side wall extended edge and a first end wall extended edge, and;

(b) folding each extended edge downwardly and perpendicular respectively to the first side wall, second side wall, and first end wall, so that each extended edge is disposed within the tray and captured between the rectangular central portion edge and the overlying extension of the second end panel.

18. The method of constructing a serving tray according to claim 17, further comprising the step of:

beveling the corners of the first and the second side wall extended edge and the first end wall extended edge so that the beveled corners are abutting one another and are coplanar when the tray is assembled.

19. The method of constructing a serving tray according to claim 12, further comprising the step of:

providing liquid impermeability for the tray by forming the sheet of material of a coated paper stock.

20. The method of constructing a serving tray according to claim 12, further comprising the step of:

providing liquid impermeability for the tray by forming the sheet of material of plastic stock.

* * * * *